US006525752B2

(12) United States Patent
Vackier et al.

(10) Patent No.: US 6,525,752 B2
(45) Date of Patent: Feb. 25, 2003

(54) EXPOSURE UNIT WITH STAGGERED LED ARRAYS

(75) Inventors: Leo Vackier, Gravenwezel (BE); Alfons Grobben, Heverlee (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 09/909,747

(22) Filed: Jul. 20, 2001

(65) Prior Publication Data

US 2002/0057324 A1 May 16, 2002

(30) Foreign Application Priority Data

Jul. 21, 2000 (GB) ..... 0017789

(51) Int. Cl.[7] ..... B41J 2/45
(52) U.S. Cl. ..... 347/130; 347/137; 347/238
(58) Field of Search ..... 347/130, 137, 347/238, 244, 256, 258

(56) References Cited

U.S. PATENT DOCUMENTS

| | | | |
|---|---|---|---|
| 4,435,064 A | 3/1984 | Tsukada et al. | |
| 5,260,718 A | 11/1993 | Rommelmann et al. | |
| 5,655,189 A | 8/1997 | Murano | |
| 5,751,327 A | 5/1998 | De Cock et al. | |

FOREIGN PATENT DOCUMENTS

| | | | |
|---|---|---|---|
| EP | 629507 | | 12/1994 |
| GB | 1 537 661 | | 7/1977 |
| JP | 10-211731 | * | 8/1998 |

* cited by examiner

*Primary Examiner*—Joan Pendegrass
(74) *Attorney, Agent, or Firm*—Knobbe, Martens, Olson & Bear, LLP

(57) ABSTRACT

The image reproduction system includes a light exposure unit and a photosensitive member having an outer surface. The exposure unit includes a staggered plurality of linear LED arrays and a staggered plurality of discrete objectives associated therewith which focus the light generated by the LED arrays on the outer surface of the photosensitive member.

21 Claims, 5 Drawing Sheets

EXPOSURE UNIT WITH STAGGERED LED ARRAYS

FIELD OF THE INVENTION

The present invention is related to an electrophotographic image reproduction system, such as a printer or a copier, wherein a latent image is formed on a photosensitive member by image-wise exposure to light using a light exposure unit based on light emitting diodes (LED) recording heads.

BACKGROUND OF THE INVENTION

In a typical electrophotographic image reproduction process, first a latent charge image is formed on a pre-charged photosensitive member by image-wise exposure to light using a light exposure unit. This latent image is subsequently made visible on the photosensitive member with charged toner particles. Examples of a photosensitive member are a photoconductive drum or belt. The developed image is transferred directly or via one or more intermediate transfer members to a receptor material, where it may be fixed simultaneously or subsequently. The receptor material can be in web- or sheet-form. To generate multi-colour images, a multiplicity of latent images each of a separate colour are formed on an equal number of photosensitive members and transferred in register to the receptor material or to an intermediate transfer member to create a registered multi-color image. Depending on the configuration's ability to print on a single side (simplex) or on both sides of the receptor material (duplex), at least four light exposure units are used in a simplex configuration and at least eight light exposure units are used in a duplex configuration. Alternately, a multi-colour image can be formed on a side of a receptor material using a single exposure unit and a single photosensitive member per side by subsequently forming latent images each of a separate colour on the photosensitive member and transferring them directly or via one or more intermediate transfer members to the receptor material.

In conventional electrophotographic systems often use is made of light exposure units including LED arrays, to generate the light, combined with an optical system to focus the light on the photosensitive member. Accurately focusing the images generated by the LEDs on corresponding points of the photosensitive surface is one of the major factors determining the image quality in such systems. As e.g. disclosed in EP629507, a LED array is typically composed of a number of LED modules, each module comprising a fixed number of LED's. These LED modules are attached to a common carrier and connected, e.g. by means of wire bonding, to adjacently attached driver modules to thereby form a linear array of LED modules and driver modules positioned perpendicular to the propagation direction of the photosensitive member. Usually the carrier also acts as a heat sink. The light generated by the light-emitting diodes, LED's, is accurately focused on the photosensitive member by means of a selfoc lens array being adequately positioned between the LED's and the photosensitive member. The selfoc lens array, SLA, is composed of two linear arrays of cylindrical lenses with a parabolic refractive index distribution, each lens having equal dimensions and optical properties. The lenses are aligned between two plates, while the space in-between the lenses is filled up with silicone to fix the lenses and to prevent crosstalk. When the SLA is correctly positioned, the images of all the LED's on the LED array are focused on the surface of the photosensitive member to form a line across the photosensitive surface perpendicular to the propagation direction of said photosensitive member. This solution works fine up to resolutions of 600 dpi. However, at higher resolutions, i.e. typically 900 dpi and above, the currently commercially available SLA's are known to give unsatisfactory results with respect to image quality, particularly sharpness and efficiency, due to the limited optical quality of the individual lenses within the SLA. Moreover, the large non-uniformity of the lenses within the SLA, which could be corrected for satisfactory at 600 dpi, becomes problematic at higher resolutions as due to the reduced spot size the image quality is more sensitive for local discontinuities in the optical system.

U.S. Pat. No. 5,260,718 (Rommelmann, Xerox) discloses a printer with staggered image bars in optical alignment with an optical system. The modulated outputs of the image bars are transmitted as focused lines on the photoreceptor. This is enabled by tilting the optical system at angles typically between 15 and 40 degrees. The optical system is preferably a linear gradient lens array. A conventional lens system, i.e. an array of discrete lenses, would not work because it is nearly impossible to mount such lenses at the required angles in a reproducible way and moreover, this would produce unacceptable image degradation at the photoreceptor.

OBJECT OF THE INVENTION

It is an object of the invention to provide an image reproduction system having a light exposure unit based on discrete objectives which gives satisfactory results at high resolutions, especially at 600 dpi or above.

SUMMARY OF THE INVENTION

We have discovered that this objective and other useful benefits can be achieved when the system comprises a specified configuration of a staggered plurality of linear LED arrays and a staggered plurality of discrete objectives associated therewith to expose the photosensitive member.

In an aspect of the invention an image reproduction system, including e.g. printing and copying systems, is disclosed comprising:

- a photosensitive member having an outer surface;
- a staggered plurality of linear LED arrays, said LED arrays being staggered such that each LED array is spaced from an imaginary plane perpendicular to the process direction of said image reproduction system;
- a staggered plurality of discrete objectives, for focussing the outputs of said LED arrays on said outer surface of said photosensitive member, each of said objectives being associated with a LED array, said objectives being oriented substantially parallel to said outer surface and positioned between said photosensitive member and said staggered plurality of linear LED arrays such that the distance from each objective to said imaginary plane is smaller than the distance from its associated LED array to said imaginary plane. The objectives may be composed of glass, quartz or other transparent materials, including polymers. Preferably the distance from each objective to said imaginary plane is 40% to 60% of the distance from its associated LED array to said imaginary plane to ensure that the outputs of the respective LED arrays are projected on the outer surface of the photosensitive member within neighbouring lines. In an embodiment of the invention, the objectives are positioned such that the outputs of the respective LED arrays are projected on the outer surface of the photosensitive member on a single common line.

In another embodiment of the invention, in order to prevent crosstalk, the image reproduction system further comprises an opaque screen being mounted between said staggered plurality of discrete objectives and said outer surface of said photosensitive member; said opaque screen being provided with a slit through which the focussed outputs of said LED arrays are projected on the outer surface of said photosensitive member. The opaque screen is preferably composed of an anti-reflective material or covered with an anti-reflective coating. In an alternative embodiment, a plurality of non-reflective opaque screens is positioned between the staggered plurality of linear LED arrays and the staggered plurality of objectives, each of said screens being positioned both between two neighbouring LED arrays and their associated objectives.

In another embodiment of the invention the length of each of the LED arrays is chosen such that when put on one line, adjacent LED arrays are partially overlapping. The overlapping or partially overlapping LED's can be individually controlled to thereby avoid discontinuous joints of projected line fragments after optically and/or electronically stitching to generate a projected image line, each of said line fragments being generated by its associated LED array. Particularly one may opt to individually modulate, or extinguish or light such overlapping or partially overlapping LED's.

DETAILED DESCRIPTION OF THE INVENTION

Figure 1:
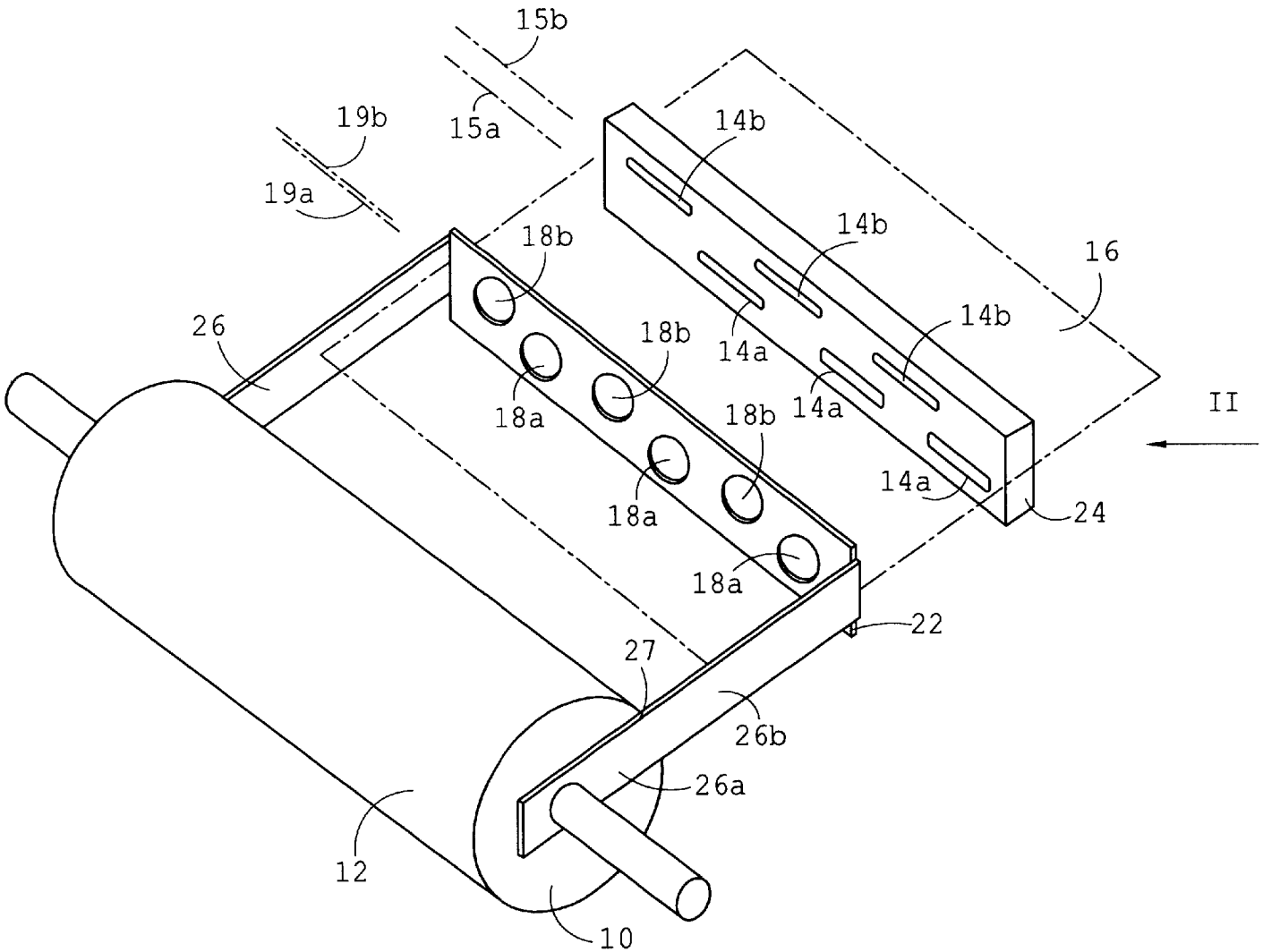
FIG. 1 is a schematic perspective view of some of the components of an exposure unit according to the invention.

An electrophotographic image reproduction system incorporates a photosensitive member and a light exposure unit which enables the formation of a latent image on the photosensitive member. Usually a latent charge image is formed on a pre-charged photosensitive member by image-wise line-after-line exposure. Using LED arrays as light sources, there are several ways to implement this. A first approach is using a LED array having a width which is at least the maximum width of the image to be reproduced. However as most reproduction systems have to be capable of reproducing at least A4 and/or A3 images, these systems have to be capable of reproducing images with a width of about 30 cm or above. However, the only optical system known which is able to project a complete line generated by a single linear LED array of a width of about 30 cm or larger is a selfoc lens array (SLA). Such a system is disclosed in U.S. Pat. No. 5,751,327 (De Cock, Xeikon) which is hereby incorporated by reference. As stated before, currently SLA's do not meet the specifications required for high quality image reproduction at resolutions of 600 dpi or above. A second approach is splitting up the line in several fragments by using a staggered plurality of linear LED arrays and using a optical system which projects the outputs of these different arrays in a staggered configuration on the photosensitive member substantially in a one to one relationship. It is clear that this is also not a preferred configuration as one has to deal with significant offset distances (typically a few mm or even more) between the different LED arrays. The only possibility is to stitch together the different fragments in a purely electronic way using large buffers. Such a system is e.g. disclosed in U.S. Pat. No. 4,435,064 (assigned to Ricoh). Although such a system might work at sufficiently low resolution and/or process speed, it is clear that it is too slow and too costly to incorporate it into reproduction system having a resolution of 450 dpi or above and having a process speed of 10 mm per second or above. A third approach is splitting up the line in several fragments by using a staggered plurality of linear LED arrays and using a staggered plurality of SLA's associated therewith. By tilting the SLA's over a predetermined angle the different fragments are optically stitched together on the photosensitive member to thereby form a complete line.

According to the present invention an image line is split up in several fragments by using a staggered plurality of linear LED arrays and is projected on the photosensitive member using a staggered plurality of discrete objectives associated therewith.

The image reproduction system comprises a photosensitive member having an outer surface. Examples thereof are a photoconductive drum or belt.

The plurality of linear LED arrays are staggered such that each LED array is spaced to an imaginary plane perpendicular to the process direction of said image reproduction system. Preferably, each LED array is placed equidistant to the imaginary plane. The linear LED arrays are only staggered in the process direction. One can opt to choose the lengths of the array fragments such that if they where put on one line a continuous line would be formed without overlaps or gaps. Because of small errors e.g. in the optics and/or the optical alignment and/or thermal influences, in practice, it is difficult to achieve this without introducing image magnification. It is obvious that image magnification negatively influences the print resolution. As an alternative however, it is preferred to deliberately add some LED's such that when the array fragments were placed on one line there would be overlapping joints. A first advantage of the availability of such overlapping LED's can be that due to small errors in the optics and or the optical alignment one can opt, in the assembling and calibration phase, to illuminate or to extinct individual LED's in order to bridge gaps or avoid overlaps at the joints when optically and potentially electronically stitching the projected outputs of the different array fragments. Another advantage can be that one can create smoother transitions at the joints by individually tuning the output power of each of the overlapping LED's. This is also particularly advantageous if a gap at a joint can not be bridged by a whole number of overlapping LED's. Furthermore, to optical system of this configuration enables the use for each of the array fragments of an aspect ratio between the image and the projected image of substantially 1:1. Substantially 1:1 means that for each LED-array fragment with associated discrete objective, the aspect ratio between the image and the projected image is a fixed number in the range from 1:0.9 to 1:1.1, even more preferably from 1:0.95 to 1:1.05.

The staggered plurality of discrete objectives are placed parallel to said staggered plurality of linear LED arrays, for focussing the outputs of said LED arrays on said outer surface of said photosensitive member. The discrete objectives are positioned such that they are substantially parallel to the surface of the photosensitive member in order to facilitate mounting and positioning and improve reliability.

Each of the objectives is associated with a LED array, the objectives being oriented substantially parallel to said outer surface and positioned between said photosensitive member and said staggered plurality of linear LED arrays such that the distance from each objective to said plane is smaller than the distance from its associated LED array to said imaginary plane. Preferably the distance from each objective to said imaginary plane is 40% to 60% of the distance from its associated LED array to said imaginary plane to ensure that the outputs of the respective LED arrays are projected on the outer surface of the photosensitive member within neighbouring lines.

Each discrete objective comprises one or more lenses. These lenses may be composed of glass, quartz or a transparent polymer. Lenses are known to have all kinds of image errors. Dependent on the type of lens (e.g. convex, concave, bi-convex, bi-concave, plan-convex, convex-concave) all kind of aberrations and other errors can appear such as e.g. chromatic aberration and spherical aberration. To correct at least partly for all these errors including astigmatism, an objective should be used being composed of at least 3 lenses. In principle, subject to the costs involved, the more lenses the better one can correct for these errors.

It is preferred that the objectives are only staggered in the process direction. The objectives are oriented substantially parallel to the outer surface of the photosensitive member which means that the angle between the optical axis of the respective objective and said imaginary plane is 5 degrees or smaller. Typically, the focal distance of the objectives is a predetermined number in the range between 25 and 125 mm. Each of the respective objectives should have a focal distance which is substantially identical. This is an important requirement which is very hard to meet as identical objectives can not be fabricated. In practice however, it is no problem to make a precise selection over larger amounts of objectives knowing that the variation in focal distance preferably should be 0.05 mm or smaller. By mounting the objectives on a flat rigid carrier the positioning along the optical axis can be very precisely controlled.

The precise positioning of the objectives along in the plane perpendicular to the optical axis is of major importance for the image quality. This is precisely done in an assembling and calibration phase using an optical microscope. In theory each objective is also quite sensitive for rotational errors, particularly for rotations around an axis perpendicular to the optical axis. In practice by mounting them on a stiff and flat alignment bar the rotational errors involved are very small and can be corrected for by small displacements in the plane perpendicular to the optical axis. It is therefore not necessary to correct for rotational errors by angular displacements which would be practically impossible. So for the optical alignment of the objectives only planar displacements, have to be performed. This alignment has to be performed on micrometer scale but this is perfectly feasible and controllable. Once an objective is properly positioned and optically aligned, the objective is connected to a rigid holder e.g. using UV curable glue. When this is done for each of the objectives the costly alignment bar can be removed and re-used for the alignment of another optical system. This holder is connected in optical alignment to the carrier to which the LED arrays and their associated drivers are attached.

The holder with the objectives, the carrier with the LED-arrays and the drivers attached thereto form a printhead which is precisely positioned to make sure that the light generated by the LED's is precisely focused on the outer surface of the photo conductor.

In another embodiment of the invention, in order to prevent crosstalk, the image reproduction system further comprises a horizontal opaque screen being mounted between said staggered plurality of discrete objectives and said outer surface of said photosensitive member; said horizontal opaque screen being provided with a slit through which the focussed outputs of said LED arrays are projected on the outer surface of said photosensitive member. The horizontal screen is preferably positioned parallel and adjacent to the outer surface of the photosensitive member. The longitudinal dimension of the slit, i.e. the dimension across the photosensitive member is greater than or equal to the maximum printing width, while the transverse dimension of the slit, i.e. the dimension along the photosensitive member (in the process direction), is typically in the order of a few millimeters. The horizontal opaque screen is preferably composed of an anti-reflective material or covered with an anti-reflective coating.

Instead of the afore-mentioned slit or combined therewith in order to prevent crosstalk a plurality of non-reflective vertical opaque screens may be positioned between the staggered plurality of linear LED arrays and the staggered plurality of objectives, each of said screens being positioned both between two neighbouring LED arrays and the associated objectives. Typically, these vertical screens are thin metal screens coated with an anti-reflective coating. In the latter case, the holder with the objectives, the carrier with the LED-arrays and drivers attached thereto and the vertically oriented opaque non-reflective screens form a printhead which is precisely positioned to make sure that the light generated by the LED's is precisely focused on the outer surface of the photo conductor.

Although preferred it is not required that the light generated by the different LED-arrays is projected on a common line. However the respective line fragments should be projected on the outer surface of the photoconductor such that the maximum distance in the process direction between the projected line fragments is 200 $\mu$m or smaller, which is about 10 lines at 1200 dpi. More preferably this maximum distance is 100 $\mu$m or smaller. By doing so the use of a large buffer, which would be costly and detrimental with respect to the maximum achievable speed and resolution of the reproduction system, can be avoided. To enable that the respective LED line fragments are focused on the photoconductor within an interline distance smaller than 200 $\mu$m or even on one common line, ideally the distance from each objective to said imaginary plane is half the distance from its associated LED array to said imaginary plane. However due to all kinds of small imperfections, small alignment errors and not completely identical objectives, in practice the distance from each objective to said imaginary plane is from 40% to 60% of the distance from its associated LED array to said imaginary plane.

Once all the elements, being the staggered plurality of LED arrays, the staggered plurality of objectives, the photosensitive member and to a lesser extent the non-reflective opaque screens, are in alignment it is a prerequisite to maintain this alignment within specifications during processing. The parameter, which can have the most significant influence over time, when not properly dealt with, is the temperature.

It is desirable that the image reproduction system has a light exposure unit which focuses the light on the photosensitive member substantially independent of temperature variation. There are different approaches possible to diminish the influence of temperature on the optical alignment within the printhead as well as the optical alignment of the printhead with respect to the outer surface of the photosensitive member. At first, a cooling circuit could be provided to cool the LED-carrier, i.e. the carrier whereto the LED arrays and the corresponding drivers are attached in a staggered configuration. For instance, reference is made to a liquid cooling system as disclosed in U.S. Pat. No. 5,751,327 (assigned to Xeikon Nev.).

Figure 5:
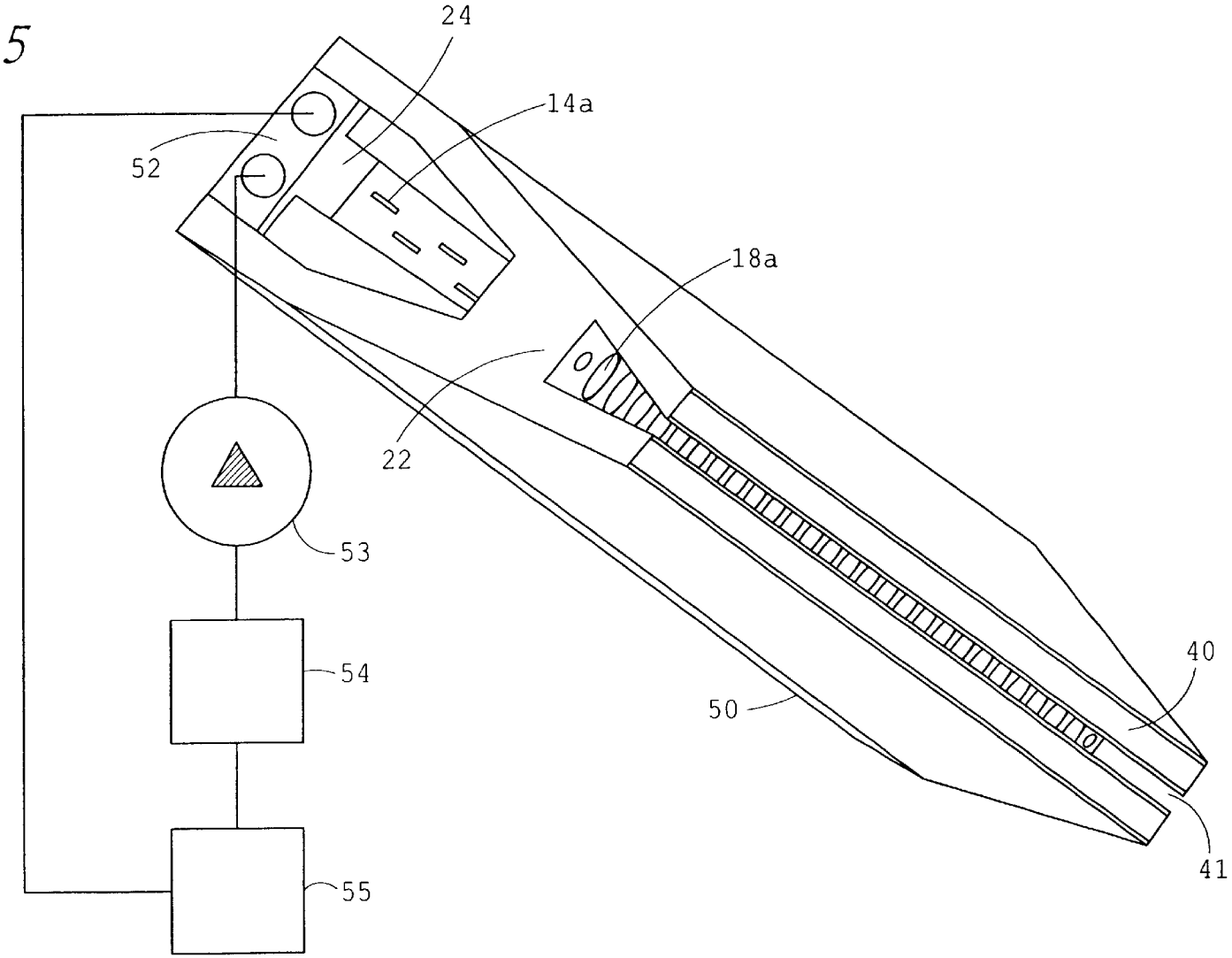
FIG. 5 is schematic perspective view of a printhead assembly according to the invention.

As shown in FIG. 5, an exemplary liquid cooling system comprises a pump 53, a liquid reservoir 54, and a heat-exchanger 55, all configured to operate as known in the art. Preferably also a liquid cooling channel 30 (see FIG. 3), is provided in thermal contact with the holder 22 of the objectives to keep this holder as well as the LED carrier 24 at about the same temperature. This channel 30 is thermally connected in series or preferably in parallel with the liquid cooling system of the LED carrier. In this case the holder and the carrier are typically formed of a metal such as aluminum, steel or copper. Alternatively, an air cooling system could be used.

A second approach can be that the material of which the holder of the objectives and the LED carrier are composed is a material with a coefficient of linear expansion of $5\times10^{-6}$ per K or below. An example of such a material is INVAR steel having a coefficient of linear expansion between $1\times10^{-6}$ per K and 2×10−6 per K. When appropriate, a cooling system for the holder as well as the carrier could still be provided. This cooling system could be a liquid cooling system or an air cooling system. In a third approach a liquid cooling system can be used for the LED carrier similar as described in the first approach while the holder of the objectives is maintained at the same predetermined temperature as the LED carrier by means of an air cooling. In a fourth approach the holder and carrier are composed of a material with the same coefficient of linear expansion. Thermal sensors are provided to register the temperature and responsive thereto the positioning of the holder and the carrier with respect to the photosensitive member may be independently adjusted. To enable this, prior to the actual printing, in a calibration step calibration tables are generated wherein for each temperature setpoint the associated optimum positions of the respective elements, such as e.g. holder and carrier, of the optical system are stored.

To further diminish the influence of temperature on the optical alignment along the optical axis within the printhead and particularly the optical alignment along the optical axis of the printhead with respect to the outer surface of the photosensitive member, the following precautions can be taken.

Firstly a rigid connection can be provided between the LED carrier and the holder of the objectives. This connection is preferably composed of the same metal as the holder and the carrier and chosen depending on the selected approach as discussed above.

Secondly, where the photosensitive member is in the form of a photoconductive drum, a rigid connection can be provided between the axis of the drum and the holder of objectives. This is preferably a two-part connection, wherein one part extends from the axis of the drum to a point parallel to the outer circumference of the drum and is composed of the same material of which the drum is formed (e.g. aluminum) and another part extends from that point to the objectives holder and is composed of a material with a low coefficient of expansion, such as INVAR. Alternatively one can omit this connection and cool the drum till about the same temperature as the carrier and the holder. Another possibility could be that the position of the surface of the drum is precisely sensed and responsive thereto the position of the entire printhead is adjusted.

In another aspect of the invention a light exposure unit is disclosed including a LED array to generate the light, and an optical system to focus the light on a common continuous line on the outer surface of the photosensitive member. The implementation is such that the LEDs are individually staggered over half a line distance to thereby define a LED array with two rows being offset to each other by half a line (being about 20 $\mu$m at 600 dpi). Each row is composed of a LED alternated with a gap of the same size. In fact each LED of the first row is associated with a LED of the second row as it shares its cathode therewith.

In general, the speed of the reproduction system, the output power of the LEDs and the sensitivity of the photosensitive member defines the time required to write a line, i.e. the line-time. The image reproduction system incorporating the individually staggered LED array according to this aspect of the invention is operated such that during the first half of the line-time the first row of LED's is addressed, while during the second half of the line-time the second row of LED's is addressed to thereby focus the light on the photosensitive member on a continuous line. The advantage thereof is that one can print with a resolution which is twice as high as the number of bonding pads required. This is of particular advantage for resolutions of 900 dpi or above as the bonding might be an issue due to the reduced spot size and associated therewith the increased density of bonding pads. This is made even more problematic if the bonding pads have reduced dimensions. Instead of two rows of LED's offset one to the other over half the line distance, n rows of LED's could be formed ("n" being a positive whole number equal to or greater than two), each of them offset to one other over 1/n of the line distance. Each LED of the first row being associated with n−1 LED's of the n−1 offset rows and sharing a cathode. Each row of LED's is then composed of an LED followed by n−1 gaps of the same size. In operation each row of LED's would be addressed for a period1/n of the line-time to thereby form a continuous line on the photosensitive member.

Figure 2:
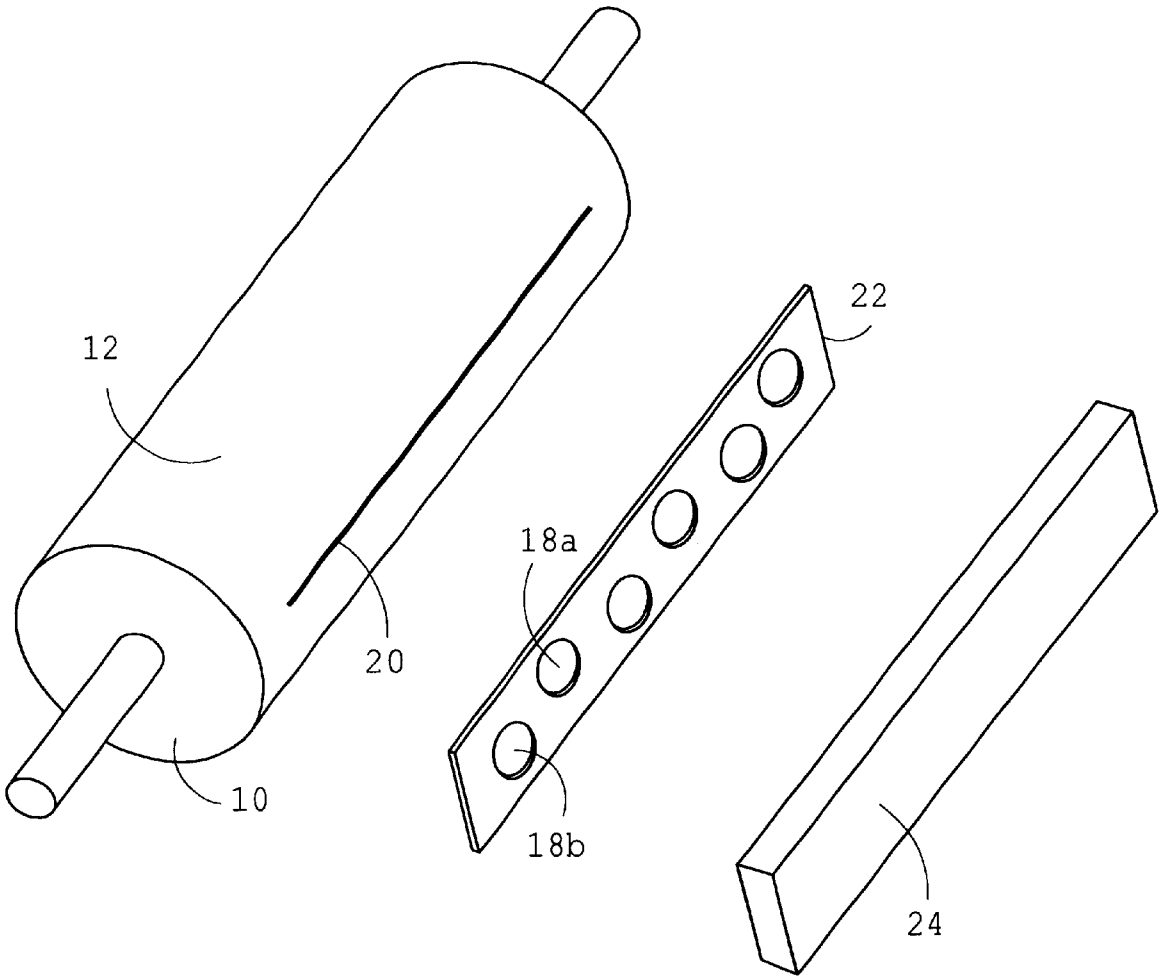
FIG. 2 is a view taken in de direction "II" in FIG. 1.

The invention will now be further described, purely by way of example, with reference to the accompanying drawings. Referring to FIGS. 1, and 2, an image reproduction system is shown including an aluminum image forming drum 10 having an outer photosensitive surface 12. A plurality of linear LED arrays 14*a*, 14*b* are arranged in two lines 15*a*, 15*b*, in a staggered arrangement such that each line of linear LED arrays is placed equidistant to an imaginary plane 16 perpendicular to the process direction of the image reproduction system. A staggered plurality of discrete objectives 18*a*, 18*b* are arranged in two lines 19*a*, 19*b*, parallel to the staggered lines of LED arrays, focuses the outputs of the LED arrays 14*a*, 14*b* on the outer surface 12 of the photosensitive drum 10, each of the objectives 18*a*, 18*b* being associated with a LED array 14*a*, 14*b*, The objectives 18*a*, 18*b* are also oriented substantially parallel to the outer surface 12 and positioned between the photosensitive drum 10 and the staggered plurality of linear LED arrays 14*a*, 14*b*. The arrangement is such that the distance from each objective 18*a*, 18*b* to the imaginary plane is smaller than the distance from its associated LED array 14*a*, 14*b* to the imaginary plane 16.

In an example, a discrete objective was used being composed of two identical mirrored sets of lenses with a diaphragm in-between. The objectives are of the type Apo-Rodagon (manufactured by Rodenstock) with a 1:1 magnification and a focal distance of 74.7 mm.

The distance from each objective 18 to the imaginary plane 16 is about 50% of the distance from its associated LED array 14*a*, 14*b* to the imaginary plane 16.

The objectives 18*a*, 18*b* are optically aligned such that they focus the outputs of the respective LED arrays 14*a*, 14*b* on a common line 20 on the outer surface 12 of the photosensitive drum 10. The objectives 18*a*, 18*b* are thermally connected to a holder 22 formed of INVAR and the LED arrays (14*a*, 14*b*) are thermally connected to a carrier 24.

A rigid connection (not shown) is provided between the LED carrier 24 and the objectives holder 22. This connection is composed of the same metal as the holder and the carrier.

A rigid connection is also provided between the axis of the drum 10 and the objectives holder 22. This is a two-part connection, wherein one part 26*a* extends from the axis of the drum 10 to a point 27 parallel to the outer surface 12 of the drum and is composed of aluminum. Another part 26*b* extends from point 27 to the objectives holder 22 and is composed of INVAR.

Figure 3:
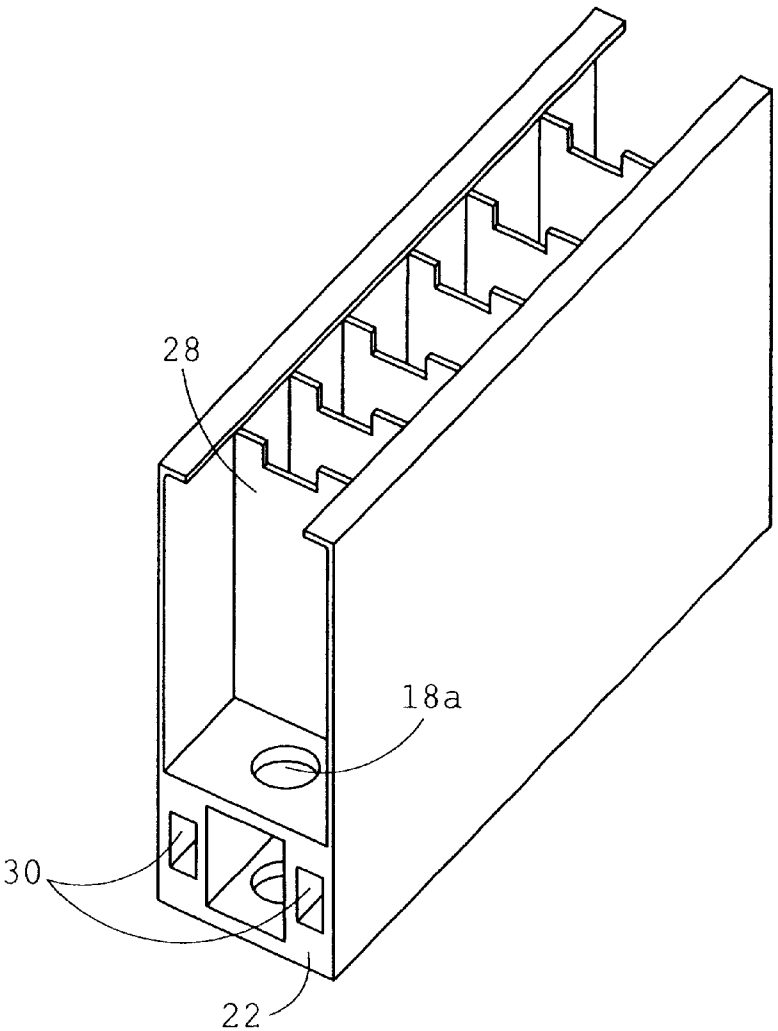
FIG. 3 is a view of the objectives holder of the unit shown in FIGS. 1 and 2.

FIG. 3 shows the objectives 18*a* etc mounted on the holder 22, which in turn is adapted to carry a plurality of thin metal vertical opaque screens 28 provided with an anti-reflective coating positioned, in use, between the staggered plurality of linear LED arrays 14*a*, 14*b* and the staggered plurality of objectives 18*a*, 18*b*, each of the screens being positioned both between two neighboring LED arrays and the associated objectives. These non-reflective opaque screens 28 avoid crosstalk between neighboring LED arrays.

Figure 4:
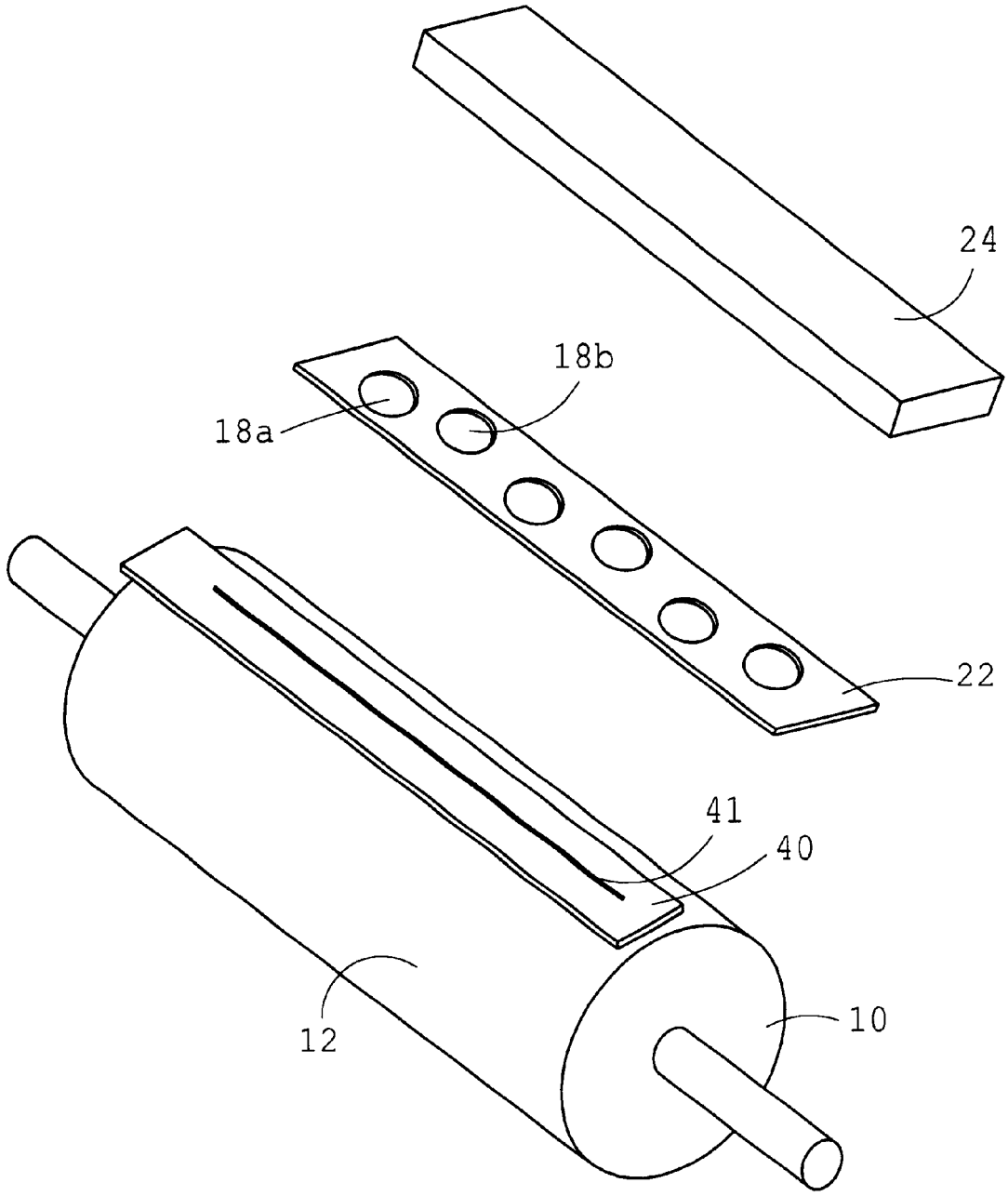
FIG. 4 is another schematic perspective view of some of the components of an exposure unit according to the invention.

FIG. 4 shows about the same image reproduction system as in FIG. 2. An opaque screen 40 is added for crosstalk prevention between neighboring LED arrays. The screen is positioned between said staggered plurality of discrete objectives 18*a*, 18*b* and said outer surface 12 of said photosensitive member 10; said opaque screen being provided with a slit 41 through which the focussed outputs of said LED arrays are projected on said outer surface of said photosensitive member.

FIG. 5 shows a printhead assembly which integrates the objectives holder 22 and the LED arrays carrier 24. The opaque screen 40 with slit 41 is functionally provided by the particular shape of the printhead assembly.

What is claimed is:

1. An image reproduction system comprising:

a photosensitive member having an outer surface;

a staggered plurality of linear light emitting diode ("LED") arrays, said LED arrays being staggered such that each LED array is spaced from an imaginary plane perpendicular to the process direction of said image reproduction system; and a staggered plurality of discrete objectives for focussing the outputs of said LED arrays on said outer surface of said photosensitive member, each of said objectives being associated with a LED array, said objectives being oriented substantially parallel to said outer surface and positioned between said photosensitive member and said staggered plurality of linear LED arrays such that the distance from each objective to said imaginary plane is from 40% to 60% of the distance from its associated LED array to said imaginary plane.

2. The system of claim 1, further comprising an opaque screen mounted between said staggered plurality of discrete objectives and said outer surface of said photosensitive member, said opaque screen having a slit through which the focussed outputs of said LED arrays are projected on said outer surface of said photosensitive member.

3. The system of claim 1, wherein said objectives are optically aligned such that they focus the outputs of their associated LED arrays on a common line on said outer surface of said photosensitive member.

4. The system of claim 1, wherein said objectives are thermally connected to a holder and said LED arrays are thermally connected to a carrier, wherein a cooler is provided to actively cool said carrier and said holder.

5. The system of claim 4, wherein said holder and said carrier are thermally connected to each other.

6. The system of claim 4, wherein said holder and said carrier are substantially composed of a material with a coefficient of linear expansion of $5\times10^{-6}$ per K or below.

7. The system of claim 1, wherein the length of each LED array is selected such that when put on one line, at least two adjacent LED arrays are partially overlapping.

8. The system of claim 7, wherein said staggered plurality of objectives is positioned such that the aspect ratio between the image and the projected image is substantially 1:1.

9. The system of claim 1, further comprising a plurality of non-reflective opaque screens positioned between said staggered plurality of linear LED arrays and said staggered plurality of objectives, each of said screens being positioned both between two neighbouring LED arrays and the associated objectives.

10. A method of creating a latent image reproduction, said method comprising:

concurrently emitting bands of light from a staggered plurality of light emitting diodes ("LED"), each band including information indicative of a portion of a line of an image to be reproduced;

focussing said bands through a staggered plurality of discrete objectives onto an outer surface of a photosensitive member, each of said staggered plurality of LED arrays being associated with one of said staggered plurality of discrete objectives; and overlapping a part of said focussed bands to form a common line on said outer surface of said photosensitive member, said common line including information indicative of said line of said image.

11. The method of claim 10, further comprising orienting said staggered plurality of discrete objectives to be substantially parallel to said outer surface and positioned between said photosensitive member and said staggered plurality of LED arrays.

12. The method of claim 11, further comprising spacing each of said staggered plurality of LED arrays at a first distance from an imaginary plane perpendicular to a process direction of said latent image reproduction.

13. The method of claim 12, further comprising spacing each of said staggered plurality of discrete objectives at a second distance from said imaginary plane perpendicular to said process direction of said latent image reproduction.

14. The method of claim 13, wherein said second distance is less than said first distance for each of said staggered plurality of LED arrays and its associated one of said staggered plurality of discrete objectives.

15. The method of claim 14, wherein said second distance is between 40% and 60% of said first distance.

16. The method of claim 10, further comprising arranging said staggered plurality of LED arrays such that when put on one line adjacent LED arrays partially overlap.

17. The method of claim 16, further comprising positioning said staggered plurality of discrete objectives such that an aspect ratio between said line of said image and said common line of said latent image reproduction is substantially 1:1.

18. The method of claim 10, further comprising optically aligning each of said staggered plurality of discrete objectives to focus the output of its associated one of said staggered plurality of LED arrays onto said common line.

19. The method of claim 10, further comprising cooling said staggered plurality of discrete objectives and said staggered plurality of LED arrays to maintain their relative alignment to one another.

20. An image reproduction system comprising:

a photosensitive member having an outer surface;

a staggered plurality of linear light emitting diode ("LED") arrays configured for concurrent activation, said LED arrays being staggered such that each LED array is spaced from an imaginary plane perpendicular to the process direction of said image reproduction system; and a staggered plurality of discrete objectives for focussing the outputs of said LED arrays on said outer surface of said photosensitive member, each of said objectives being associated with a LED array, said objectives being oriented substantially parallel to said outer surface and positioned between said photosensitive member and said staggered plurality of linear LED arrays such that the distance from each objective to said imaginary plane is from 40% to 60% of the distance from its associated LED array to said imaginary plane.

21. A system for creating a latent image reproduction, said system comprising:

means for concurrently emitting bands of light, each band including information indicative of a portion of a line of an image to be reproduced;

means for focussing said bands onto an outer surface of a photosensitive member; and means for overlapping a part of said focussed bands to form a common line on said outer surface of said photosensitive member, said common line including information indicative of said line of said image.

* * * * *